US008357018B2

(12) United States Patent
Takeda et al.

(10) Patent No.: US 8,357,018 B2
(45) Date of Patent: Jan. 22, 2013

(54) OUTBOARD MOTOR ANTITHEFT APPARATUS

(75) Inventors: Masato Takeda, Wako (JP); Yoshihisa Shinogi, Wako (JP); Masashi Manita, Wako (JP); Kosei Yamashita, Wako (JP); Makoto Yamamura, Wako (JP); Yoshinori Maekawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 86 days.

(21) Appl. No.: 12/961,012

(22) Filed: Dec. 6, 2010

(65) Prior Publication Data

US 2011/0136398 A1 Jun. 9, 2011

(30) Foreign Application Priority Data

Dec. 9, 2009 (JP) ..... 2009-279928

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS 6,077,133 A 6/2000 Kojima et al.
2004/0121666 A1 6/2004 Okuyama
2005/0099265 A1* 5/2005 Dix et al. ..... 340/5.72
2010/0007497 A1* 1/2010 Takeda et al. ..... 340/572.1

FOREIGN PATENT DOCUMENTS

EP 1 288 411 A2 3/2003
JP 2003-056228 2/2003
JP 2004-359140 12/2004
JP 2006-142880 A 6/2006
JP 2007-090908 A 4/2007

OTHER PUBLICATIONS

Notice of Grounds for Rejections issued to JP Application No. 2009-279928 mailed Jun. 20, 2012.

* cited by examiner

*Primary Examiner* — Stephen Avila
(74) *Attorney, Agent, or Firm* — Arent Fox LLP

(57) ABSTRACT

In an apparatus for preventing theft of plural, such as two, outboard motors (12F, 12S) adapted to be mounted on a boat, each of the outboard motors having an engine (16F, 16S), an engine controller (24F, 24S), and an authenticator (26F, 26S) that acquires ID information (A, B) from an electronic key (30F, 30S) when the key is brought close thereto by an operator, and gives permission to the engine controller to start the engine when the acquired ID information corresponds with the authentication ID information, and communicates with the engine controller of other outboard motor to notify that the permission to start the engine was given, thereby enabling the operator to easily start the outboard motors installed on one boat and having their respective authenticators.

4 Claims, 5 Drawing Sheets

OUTBOARD MOTOR ANTITHEFT APPARATUS

BACKGROUND OF THE INVENTION

1. Field of the Invention

This invention relates to an outboard motor antitheft apparatus, particularly to an antitheft apparatus for a plurality of outboard motors to be installed on one boat.

2. Description of the Related

Conventionally, an antitheft apparatus (so-called an "immobilizer") for equipment like a vehicle having an internal combustion engine as a prime mover is known which, when an electronic key storing ID information is brought close thereto by the operator, sends the ID information to an immobilizer controller to verify it with authentication ID information, and only when the authentication is verified (the ID information is valid), allows the engine to be started with the electronic key, thereby preventing theft, as taught, for example, by Japanese Laid-Open Patent Application No. 2007-90908.

SUMMARY OF THE INVENTION

However, for instance, in the case where the equipment comprises a plurality of outboard motors installed on one boat, which is called the multiple outboard motor installation, and each outboard motor is equipped with the above antitheft apparatus, it is necessary for the operator to separately manipulate electronic keys associated with the outboard motors for starting all the outboard motors. Specifically, in order to start all the outboard motors, the operator needs to carry and distinguish a plurality of the electronic keys, while repeating the similar checking operation several times. It requires additional work and hence, is troublesome.

An object of this invention is therefore to overcome the aforesaid problem by providing an outboard motor antitheft apparatus that enables (the operator) to easily start a plurality of outboard motors installed on one boat and having their respective antitheft devices.

In order to achieve the object, this invention provides in its first aspect an apparatus for preventing theft of outboard motors adapted to be mounted on a stern of a boat, each of the outboard motors having an internal combustion engine and an engine controller for controlling operation of the engine, comprising: an authenticator that is installed in each of the outboard motors and that acquires ID information from an electronic key when the key is brought close thereto by an operator, compares the acquired ID information with authentication ID information, and gives permission to the engine controller to start the engine when it is determined that the acquired ID information corresponds with the authentication ID information, wherein the authenticator communicates with the engine controller of other of the outboard motors to notify that the permission to start the engine was given.

In order to achieve the object, this invention provides in its second aspect a method for preventing theft of outboard motors adapted to be mounted on a stern of a boat, each of the outboard motors having an internal combustion engine and an engine controller for controlling operation of the engine, comprising the steps of: acquiring ID information from an electronic key when the key is brought close thereto by an operator, comparing the acquired ID information with authentication ID information, giving permission to the engine controller to start the engine when it is determined that the acquired ID information corresponds with the authentication ID information, and communicating with the engine controller of other of the outboard motors to notify that the permission to start the engine was given.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

An outboard motor antitheft apparatus according to an embodiment of the invention will now be explained with reference to the attached drawings.

Figure 1:
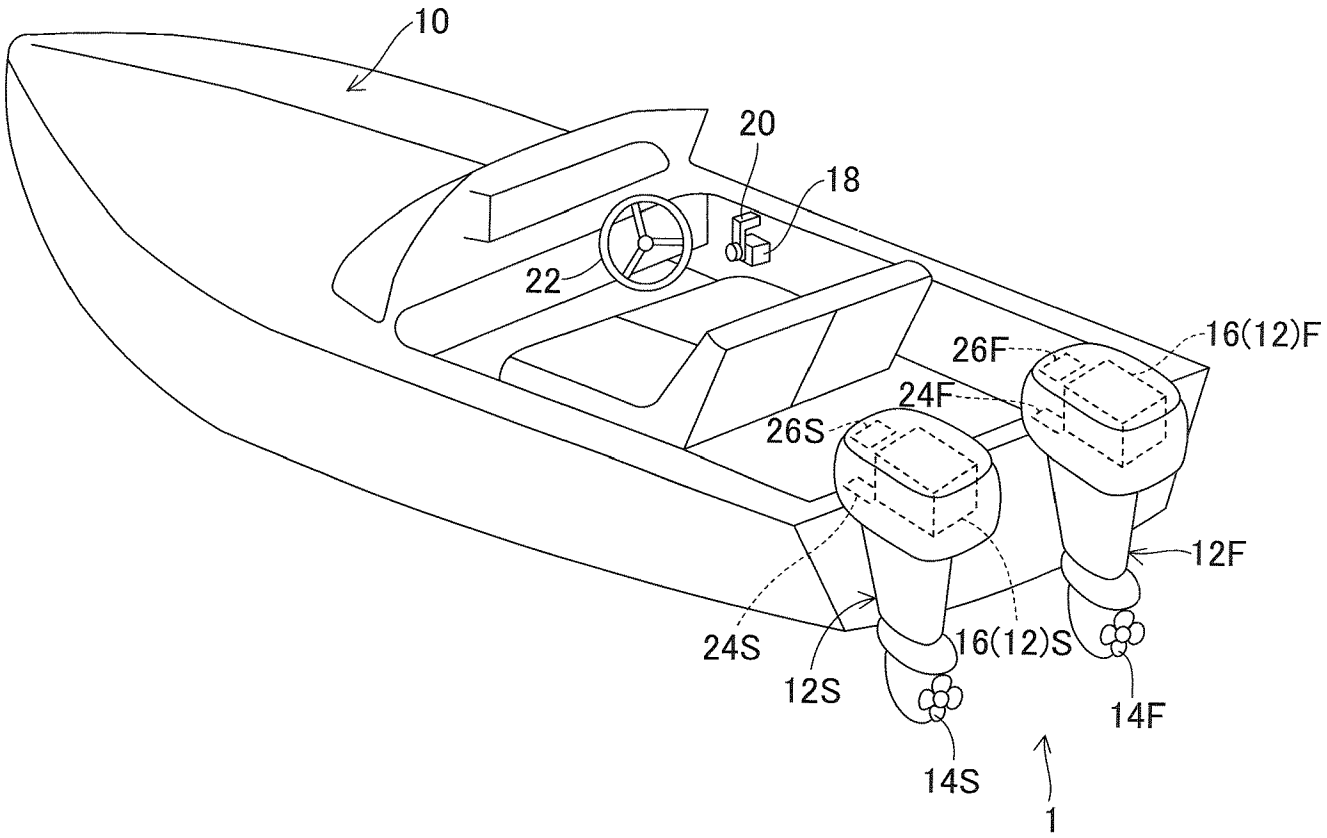
FIG. 1 is an overall schematic view of an outboard motor antitheft apparatus including a boat (hull) according to an embodiment of the invention.

FIG. 1 is an overall schematic view of an outboard motor antitheft apparatus including a boat (hull) according to an embodiment of the invention;

In FIG. 1, symbol 1 indicates an outboard motor antitheft apparatus. As illustrated, a plurality of, i.e., two outboard motors 12 are clamped (fastened) to the stern or transom of a boat (hull) 10, which is called the "multiple outboard motor installation." In other words, the outboard motors 12 comprise a group of outboard motors to be installed on the one boat 10. In the following, the starboard side outboard motor, i.e., outboard motor on the right side when looking in the direction of forward travel is called a first outboard motor and designated by 12F, while the port side outboard motor, i.e., outboard motor on the left side a second outboard motor and designated by 12S. Constituent members of the first outboard motor 12F and that of the second outboard motor 12S below are suffixed by "F" and "S," respectively.

The first and second outboard motors 12F, 12S are equipped with propellers 14F, 14S and internal combustion engines 16F, 16S. The propellers 14F, 14S are rotated by power transmitted from the engines 16F, 16S and produce thrust for propelling the boat 10. Each of the engines 16F, 16S comprises a spark-ignition gasoline engine with a displacement of 2,200 cc. The engines 16F, 16S are located above the water surface and covered by engine covers.

A remote control box 18 is installed near a cockpit or operator's seat of the boat 10. The remote control box 18 is equipped with a lever 20 to be operable by the operator. The lever 20 can be moved (swung) fore and aft, i.e., toward and away from the operator from its initial position, by which the operator can input shift (gear) position commands and engine speed regulation commands. A lever position sensor (not shown) is installed near the lever 20 and produces an output or signal corresponding to a position of the operated lever 20. A steering wheel 22 is installed near the cockpit to be rotatably manipulated. The operator manipulates the steering wheel 22 to input steering or turning commands. A steering angle sensor (not shown) is installed at a rotary shaft of the steering wheel 22 and produces an output or signal indicative of steering angle of the steering wheel 22.

The first and second outboard motors 12F, 12S are installed near the engines 16F, 16S with Electronic Control Units (hereinafter called the "engine ECUs" or "engine controller") 24F, 24S that control the operation of the engines 16F, 16S and other components of the outboard motors 12F, 12S, respectively. Each of the engine ECUs 24F, 24S comprises a microcomputer having a CPU, ROM, memory, input/output circuit and the like. The outputs of the forgoing sensors are inputted to the engine ECUs 24F, 24S, separately. Based on the inputted outputs, the engine ECUs 24F, 24S control the operation of the engines 16F, 16S and other components of the outboard motors 12F, 12S in accordance with programs stored in the ROMs.

Details of the outboard motor are described in Japanese Laid-Open Patent Application No. 2006-142880 proposed by the applicant earlier and the further explanation is omitted here.

The first and second outboard motors 12F, 12S are also installed near the engine ECUs 24F, 24S with other Electronic Control Units (hereinafter called the "authentication ECUs" or "authenticator") 26F, 26S that perform authentication check of electronic keys so as to prevent the outboard motors from theft. Each of the authentication ECUs 26F, 26S similarly comprises a microcomputer having a CPU, ROM, memory, input/output circuit and the like. Upon the manipulation of an electronic key, the authentication ECU 26F, 26S acquires ID information stored in the key, determines whether the acquired ID information corresponds with authentication ID information of the outboard motor 12F, 12S, and when they are determined to correspond with each other, allows the engine 16F, 16S of the outboard motor 12F, 12S to start.

The engine ECUs 24F, 24S and authentication ECUs 26F, 26S are activated upon the supply of power from a battery disposed in the first and second outboard motors 12F, 12S or the boat 10.

Figure 2:
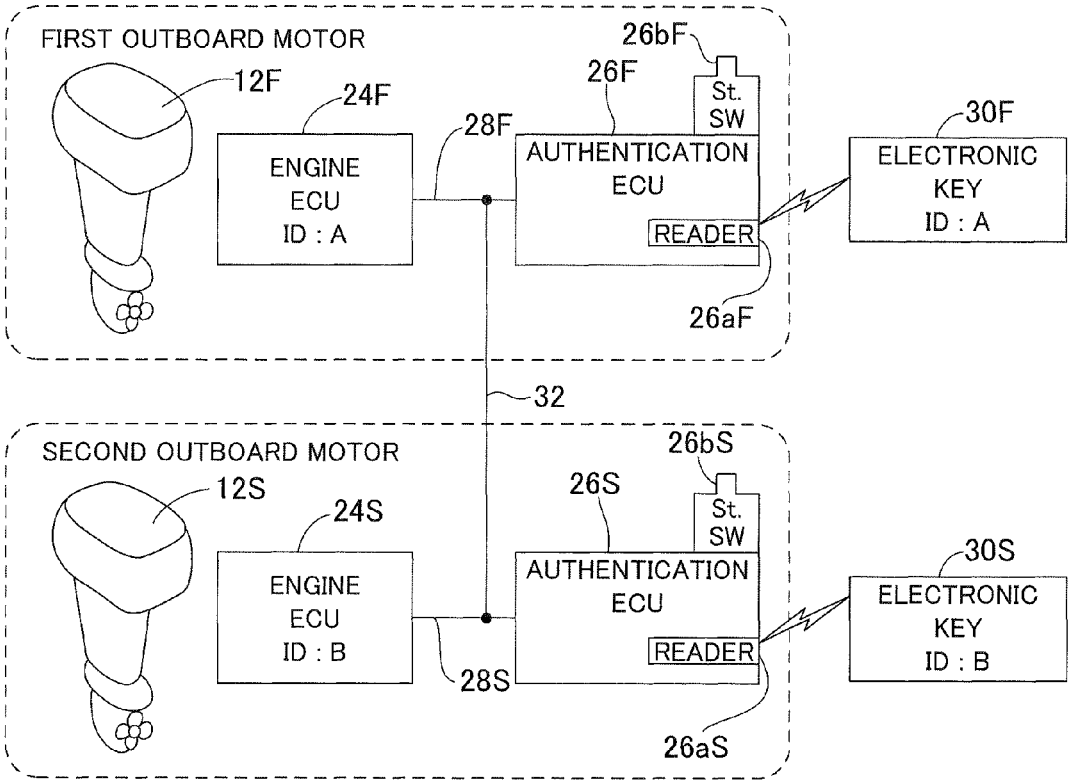
FIG. 2 is a block diagram showing the configuration of the apparatus shown in FIG. 1.

FIG. 2 is a block diagram showing the configuration of the engine ECUs 24F, 24S and authentication ECUs 26F, 26S of the outboard motors 12F, 12S.

In the first outboard motor 12F, the engine ECU 24F and authentication ECU 26F are interconnected to communicate with each other by a communication line (first wire) 28F. The engine ECU 24F stores ID information A (authentication ID information; indicated by "ID: A" in the drawing) used to identify the engine 16F of the first outboard motor 12F. The ID information comprises a string of several characters.

A card-shaped electronic key 30F for the first outboard motor 12F stores the ID information A (indicated by "ID: A") which is the same as that stored in the engine ECU 24F.

The authentication ECU 26F is equipped with a reader 26*a*F. When the key 30F is brought close to the authentication ECU 26F of the first outboard motor 12F by the operator, the authentication ECU 26F can acquire the ID information A from the key 30F through the reader 26*a*F by wireless communication (more precisely, the contactless-type short-distance wireless communication). The authentication ECU 26F verifies the acquired ID information A of the key 30F with the ID information A of the engine 16F of the first outboard motor 12F sent through the communication line 28F.

In this case, since the above two data of the ID information A correspond with each other, the authentication ECU 26F sends an enable signal to the engine ECU 24F, whereby the engine ECU 24F makes the engine 16F ready for start, more exactly, enables the ignition. Under this condition, when a starter switch 26*b*F associated with the authentication ECU 26F is made ON, the engine 16F is started.

On the other hand, when the authentication ECU 26F determines in its authentication operation that the ID information acquired from an electronic key does not correspond with the ID information A of the engine 16F, the authentication ECU 26F does not send the enable signal to the engine ECU 24F. Consequently, since the ignition is not enabled, even when the starter switch 26*b*F is made ON, the engine 16F is not started.

The same configuration is applied to the second outboard motor 12S. Specifically, the engine ECU 24S and authentication ECU 26S are interconnected by a communication line (first line) 28S. The engine ECU 24S stores ID information B (authentication ID information; indicated by "ID: B") used to identify the engine 16S of the second outboard motor 12S.

An electronic key 30S for the second outboard motor 12S stores the ID information B (indicated by "ID: B") which is the same as that stored in the engine ECU 24S.

When the key 30S is brought close to the authentication ECU 26S of the second outboard motor 12S by the operator, the authentication ECU 26S can acquire the ID information B from the key 30S through a reader 26*a*S by wireless communication. The authentication ECU 26S verifies the acquired ID information B of the key 30S with the ID information B of the engine 16S of the second outboard motor 12S sent through the communication line 28S.

Since the above two data of the ID information B correspond with each other, the authentication ECU 26S sends the enable signal to the engine ECU 24S, whereby the engine ECU 24S makes the engine 16S ready for start, more exactly, enables the ignition. Under this condition, when a starter switch 26*b*S associated with the authentication ECU 26S is made ON by the operator, the engine 16S is started.

On the other hand, when the authentication ECU 26S determines that the ID information acquired from an electronic key 30 does not correspond with the ID information B of the engine 16S, the authentication ECU 26S does not send the enable signal to the engine ECU 24S. Consequently, since the ignition is not enabled even when the starter switch 26*b*S is made ON by the operator, the engine 16S is not started.

Thus, the first (second) outboard motor 12F (12S) is configured such that, when the authentication ECU 26F (26S) determines that the ID information A (B) in the key 30F (30S) corresponds with the authentication ID information A (B) in the engine ECU 24F (24S), the engine start is enabled or allowed and when the two data of ID information do not correspond with each other, the engine start is disabled, thereby preventing theft of the outboard motor 12F (12S) and the boat 10.

The apparatus 1 according to this embodiment is characterized in that, as illustrated, a connecting line (second wire) 32 is provide which connects the communication line 28F of the first outboard motor 12F with the communication line 28S of the second outboard motor 12S, and vice versa. Owing to this configuration, the authentication ECU 26F of the first outboard motor 12F and the engine ECU 24S of the second outboard motor 12S can communicate with each other. In other words, the first and second outboard motors 12F, 12S can exchange their information related to authentication through the connecting line 32, thereby facilitating the starting operation of the outboard motors 12F, 12S. In the following, more details of the operation of the apparatus 1 will be explained.

Figure 3:
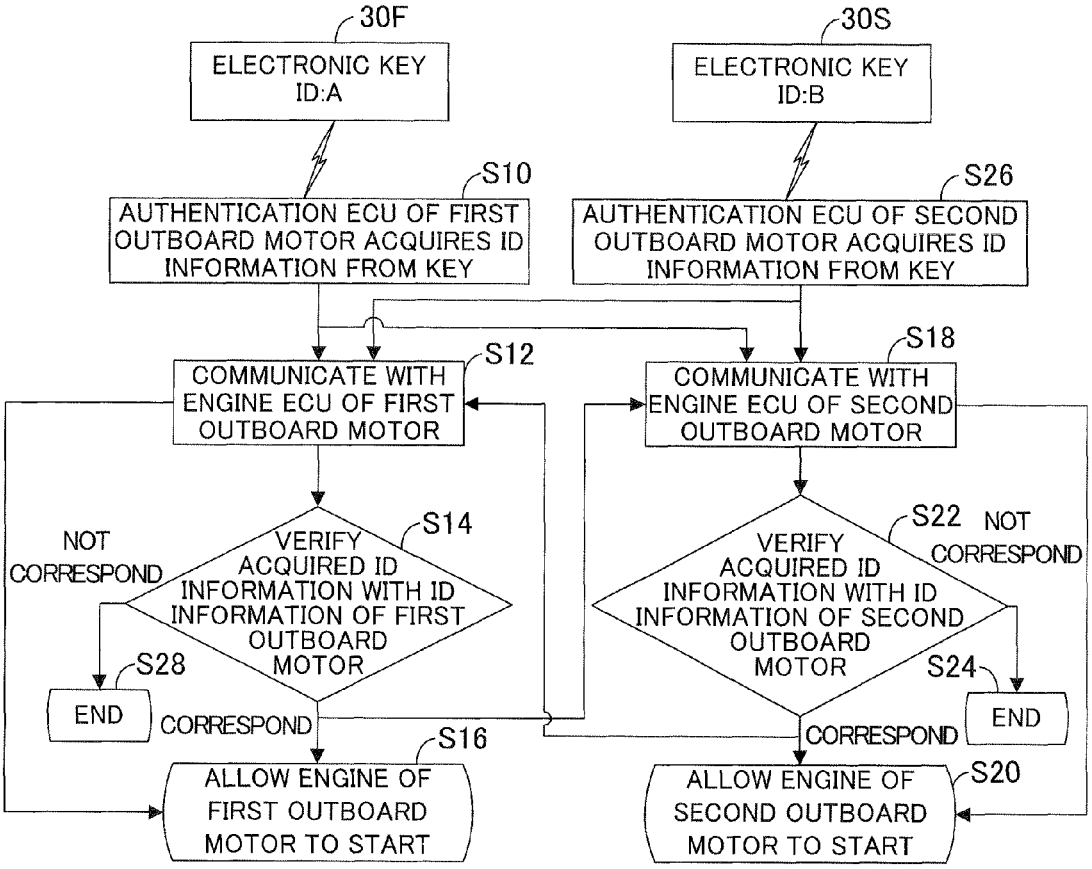
FIG. 3 is a flowchart showing the operation of the apparatus shown in FIG. 2 for starting engines of first outboard motor and second outboard motor.

FIG. 3 is a flowchart showing the operation of the apparatus 1 for starting the engines 16F, 16S of the first and second outboard motors 12F, 12S.

First, in S10, when the key 30F having the ID information A for the first outboard motor 12F is brought close to the reader 26*a*F of the authentication ECU 26F of the first outboard motor 12F by the operator, the authentication ECU 26F acquires the ID information A from the key 30F.

Next, in S12, the authentication ECU 26F communicates with the engine ECU 24F of the first outboard motor 12F and in S14, the authentication ECU 26F verifies or compares the ID information A of the key 30F with the ID information A of the first outboard motor 12F stored in the engine ECU 24F.

Since the two data of the ID information A correspond with each other, the authentication is verified and the program proceeds to S16, in which the authentication ECU 26F allows the engine 16F to start (gives permission to the engine ECU 24F to start the engine 16F), while proceeding to S18, in which the authentication ECU 26F communicates with the engine ECU 24S of the second outboard motor 12S through the connecting line 32, so that the authentication ECU 26F sends authentication-verified information of the first outboard motor 12F to the engine ECU 24S (to notify that the permission to start the engine 16F was given).

Then, in S20, the authentication ECU 26F also allows the engine 16S of the second outboard motor 12S to start (more precisely, based on the sent authentication-verified information of the first outboard motor 12F, the engine ECU 24S makes the engine 16S ready for start).

Further, after S10 in which the authentication ECU 26F acquires the ID information A from the key 30F as mentioned above, the program also proceeds to S18, in which the authentication ECU 26F communicates with the engine ECU 24S of the second outboard motor 12S through the connecting line 32, and to S22, in which the authentication ECU 26F verifies the ID information A of the key 30F with the ID information B of the second outboard motor 12S stored in the engine ECU 24S. In this case, since the two data of the ID information A, B do not correspond with each other, the program proceeds to S24 to be terminated.

The above operation is similarly conducted when the key 30S is brought close to the authentication ECU 26S of the second outboard motor 12S.

Specifically, in S26, when the key 30S having the ID information B for the second outboard motor 12S is brought close to the reader 26*a*S of the authentication ECU 26S of the second outboard motor 12S by the operator, the authentication ECU 26S acquires the ID information B from the key 30S.

Next, in S18, the authentication ECU 26S communicates with the engine ECU 24S and in S22, the authentication ECU 26S verifies the ID information B of the key 30S with the ID information B of the second outboard motor 12S stored in the engine ECU 24S.

Since the two data of the ID information B correspond with each other, the authentication is verified and the program proceeds to S20, in which the authentication ECU 26S allows the engine 16S to start, while proceeding to S12, in which the authentication ECU 26S communicates with the engine ECU 24F of the first outboard motor 12F through the connecting line 32, so that the authentication ECU 26S sends authentication-verified information of the second outboard motor 12S to the engine ECU 24F. Then, in S16, the authentication ECU 26S also allows the engine 16F of the first outboard motor 12F to start.

Further, after S26 in which the authentication ECU 26S acquires the ID information B from the key 30S as mentioned above, the program also proceeds to S12, in which the authentication ECU 26S communicates with the engine ECU 24F of the first outboard motor 12F through the connecting line 32, and to S14, in which the authentication ECU 26S verifies the ID information B of the key 30S with the ID information A of the first outboard motor 12F stored in the engine ECU 24F. In this case, since the two data of the ID information B, A do not correspond with each other, the program proceeds to S28 to be terminated.

Thus, when the authentication ECU 26F (26S) of the first (second) outboard motor 12F (12S) determines that the authentication for starting the engine 16F (16S) is verified, it makes the engine 16F (16S) ready for start, while transmitting the authentication-verified information to the engine ECU 24S (24F) of the second (first) outboard motor 12S (12F) to make the engine 16S (16F) ready for start. Therefore, when each of the first and second outboard motors 12F, 12S is equipped with an antitheft device (such as the authentication ECU 26) separately, the authentication operation of only either one of the outboard motors 12F, 12S can make the both outboard motors 12F, 12S (more exactly, the engines 16F, 16S thereof) ready for start, thereby easily starting the outboard motors 12F, 12S.

Figure 4:
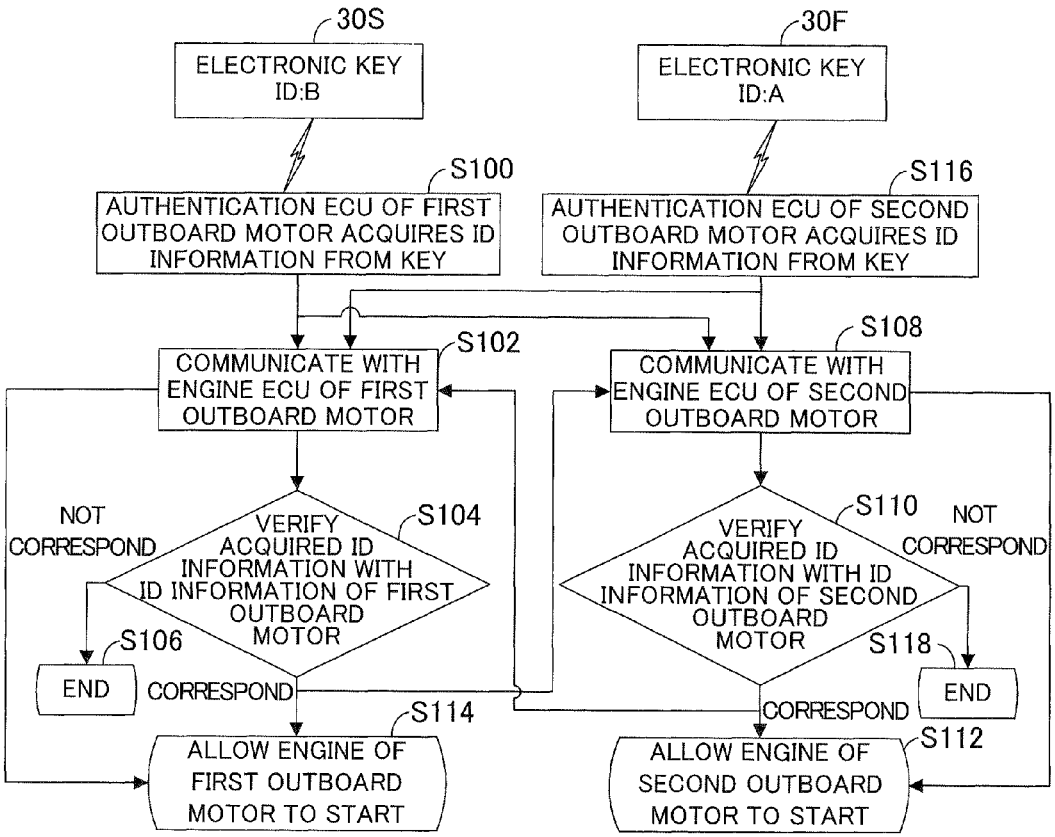
FIG. 4 is a flowchart similar to FIG. 3 but showing another operation of the apparatus shown in FIG. 2 for starting the engines of the first outboard motor and second outboard motor.

FIG. 4 is a flowchart similar to FIG. 3 but showing the operation of the apparatus 1 for starting the engines 16F, 16S. What is different from FIG. 3 is that, in FIG. 4, the key 30S for the second outboard motor 12S is brought close to the authentication ECU 26F of the first outboard motor 12F and vice versa. In other words, the remaining configuration is the same as that of FIG. 3.

First, in 5100, when the key 30S having the ID information B for the second outboard motor 12S is brought close to the reader 26*a*F of the authentication ECU 26F of the first outboard motor 12F, the authentication ECU 26F acquires the ID information B from the key 30S.

Next, in S102, the authentication ECU 26F communicates with the engine ECU 24F of the first outboard motor 12F and in S104, the authentication ECU 26F verifies or compares the ID information B of the key 30S with the ID information A of the first outboard motor 12F stored in the engine ECU 24F. In this case, since the two data of the ID information B, A do not correspond with each other, the program proceeds to S106 to be terminated.

Further, after S100 in which the authentication ECU 26F acquires the ID information B from the key 30S as mentioned above, the program also proceeds to S108, in which the authentication ECU 26F communicates with the engine ECU 24S of the second outboard motor 12S through the connecting line 32, and to S110, in which the authentication ECU 26F verifies the ID information B of the key 30S with the ID information B of the second outboard motor 12S stored in the engine ECU 24S.

Since the two data of the ID information B correspond with each other, the authentication is verified and the program proceeds to S112, in which the authentication ECU 26F of the first outboard motor 12F allows the engine 16S of the second outboard motor 12S to start through the engine ECU 24S thereof (gives permission to the engine ECU 24S to start the engine 16S), while proceeding to S102, in which the authentication ECU 26F communicates with the engine ECU 24F, so that the authentication ECU 26F sends authentication-verified information of the second outboard motor 12S to the engine ECU 24F (to notify that the permission to start the engine 16F was given). Then, in S114, the authentication ECU 26F also allows the engine 16F of the first outboard motor 12F to start.

The above operation is similarly conducted when the key 30F for the first outboard motor 12F is brought close to the authentication ECU 26S of the second outboard motor 12S.

Specifically, first, in S116, when the key 30F having the ID information A for the first outboard motor 12F is brought close to the reader 26*a*S of the authentication ECU 26S of the second outboard motor 12S, the authentication ECU 26S acquires the ID information A from the key 30F.

Next, in S108, the authentication ECU 26S communicates with the engine ECU 24S of the second outboard motor 12S and in S110, the authentication ECU 26S verifies the ID information A of the key 30F with the ID information B of the second outboard motor 12S stored in the engine ECU 24S. In this case, since the two data of the ID information A, B do not correspond with each other, the program proceeds to S118 to be terminated.

Further, after S116 in which the authentication ECU 26S acquires the ID information A from the key 30F as mentioned above, the program also proceeds to S102, in which the authentication ECU 26S communicates with the engine ECU 24F of the first outboard motor 12F through the connecting line 32, and to S104, in which the authentication ECU 26S verifies the ID information A of the key 30F with the ID information A of the first outboard motor 12F stored in the engine ECU 24F.

Since the two data of the ID information A correspond with each other, the authentication is verified and the program proceeds to S114, in which the authentication ECU 26S of the second outboard motor 12S allows the engine 16F of the first outboard motor 12F to start through the engine ECU 24F thereof, while proceeding to S108, in which the authentication ECU 26S communicates with the engine ECU 24S, so that the authentication ECU 26S sends authentication-verified information of the first outboard motor 12F to the engine ECU 24S. Then, in S112, the authentication ECU 26S also allows the engine 16S of the second outboard motor 12S to start.

Thus, even when the authentication ECU 26F (26S) of the first (second) outboard motor 12F (12S) determines that the authentication for starting the engine 16F (16S) is not verified, it communicates with the second (first) outboard motor 12S (12F) (i.e., the other outboard motor) through the connecting line 32 and when the ID information B (A) acquired from the key 30S (30F) corresponds with the authentication ID information B (A) in the engine ECU 24S (24F), makes the both outboard motors 12F, 12S (more exactly, the engines 16F, 16S thereof) ready for start. Therefore, in the authentication operation in this embodiment, without distinguishing and identifying to which of the outboard motors 12F, 12S the key 30F, 30S corresponds, it becomes possible to make the outboard motors 12F, 12S ready for start, thereby easily starting the outboard motors 12F, 12S.

In the case that an electronic key other than the electronic keys 30F, 30S is used, since the authentication is not verified in any of steps of S14, S22, S104 and S110, the first and second outboard motors 12F, 12S are not allowed to start, thereby reliably preventing theft.

Further, when either one of the first and second outboard motors 12F, 12S is removed and a third outboard motor is installed instead, unless the connecting line 32 is provided and the aforementioned initial setting is set, the outboard motors can not be operated.

As stated above, the embodiment is configured to have an apparatus (1) and method for preventing theft of outboard motors (12F, 12S) adapted to be mounted on a stern of a boat (10), each of the outboard motors having an internal combustion engine (16F, 16S) and an engine controller (engine ECU 24F, 24S) for controlling operation of the engine, characterized by: an authenticator (authentication ECU 26F, 26S) that is installed in each of the outboard motors (12F, 12S) and that acquires ID information (A, B) from an electronic key (30F, 30S) when the key is brought close thereto by an operator (S10, S100; S26, S116), compares the acquired ID information (A, B) with authentication ID information (S14, S104; S22, S110), and gives permission to the engine controller (24F, 24S) to start the engine when it is determined that the acquired ID information corresponds with the authentication ID information (S16, S114; S20, S112), and the authenticator (26F, 26S) communicates with the engine controller (24S, 24F) of other of the outboard motors (12S, 12F) to notify that the permission to start the engine was given (S18, S108; S12, S102).

Specifically, when the authentication is verified in one of the outboard motors, the authentication-verified information is transmitted to the other outboard motor and based on the transmitted information, the engine controller (engine ECU) of the other outboard motor allows the engine thereof to start. Hence, it is not necessary to conduct the authentication operation in the other outboard motor. With this, even though each of the outboard motors is equipped with an antitheft device (authentication ECU) separately, it suffices if the operator carries either one of the electronic keys for the outboard motors and the authentication operation of only one of the outboard motors can make all the outboard motors ready for start, thereby easily starting a plurality of the outboard motors. Further, in the apparatus and method, the authenticator (26F, 26S) communicates with other of the outboard motors (12S, 12F) such that the authenticator (26F, 26S) compares the acquired ID information (B, A) with authentication ID information of the other outboard motor (12S, 12F) and gives the permission to the engine controllers (24S, 24F) to start the engines (16S, 16F) when it is determined that the acquired ID information corresponds with the authentication ID information (S100, S108, S110, S112; S116, S102, S104, S114).

Specifically, even when the ID information acquired by one of the outboard motors does not correspond with the ID information stored in the one, the one outboard motor communicates with the other of the outboard motors and when the acquired ID information corresponds with the ID information stored in the other, all the outboard motors are made ready for start. With this, it becomes possible to more easily start a plurality of the outboard motors.

Further, in the apparatus and method, the engine controller (24F, 24S) and the authenticator (26F, 26S) of each of the outboard motors (12F, 12S) are connected by a first wire (28F, 28S) and each of the first wire is connected by a second wire (32) such that the authenticator communicates with the engine controller of other of the outboard motors through the second wire.

Further, in the case where one of the authentication units of the outboard motors is failed, the other authentication unit can be used to make all the outboard motors ready for start.

It should be noted that, in the foregoing, the wireless communication may be used in place of the connecting line 32.

Figure 5:
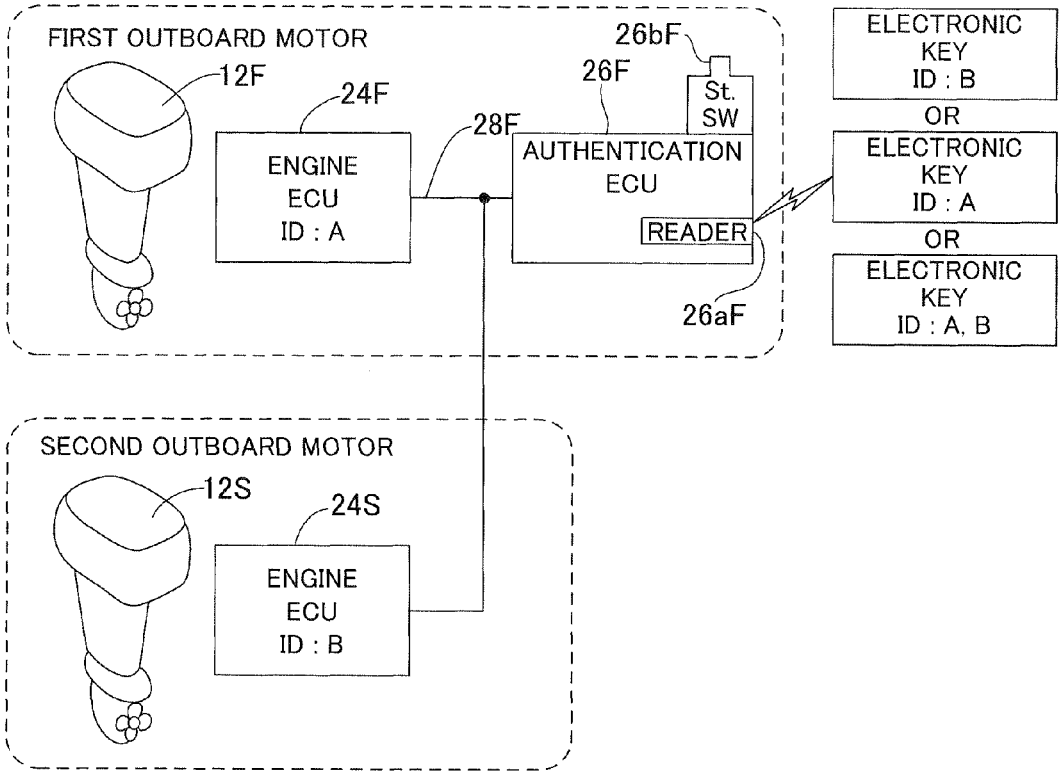
FIG. 5 is a block diagram similar to FIG. 2 but showing the configuration of the apparatus shown in FIG. 1.

It should also be noted that, since the two outboard motors are interconnected by the connecting line 32, one redundant authentication ECU may be removed to configure as shown in FIG. 5. In this case, the electronic key 30 is adapted to store the two data of the ID information A, B for the first and second outboard motors 12F, 12S.

It should also be noted that although, in the foregoing, two outboard motors are mounted on the boat 10, the invention can also be applied to multiple outboard motor installations comprising three or more outboard motors.

Japanese Patent Application No. 2009-279928, filed on Dec. 9, 2009, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for preventing theft of outboard motors adapted to be mounted on a stern of a boat, each of the outboard motors having an internal combustion engine and an engine controller for controlling operation of the engine, comprising:

an authenticator that is installed in each of the outboard motors and that acquires ID information from an electronic key when the key is brought close thereto by an operator, compares the acquired ID information with authentication ID information, and gives permission to the engine controller to start the engine when it is determined that the acquired ID information corresponds with the authentication ID information, wherein the authenticator communicates with the engine controller of other of the outboard motors to notify that the permission to start the engine was given and wherein the engine controller and the authenticator of each of the outboard motors are connected by a first wire and each of the first wire is connected by a second wire such that the authenticator communicates with the engine controller of other of the outboard motors through the second wire.

2. The apparatus according to claim 1, wherein the authenticator communicates with other of the outboard motors such that the authenticator compares the acquired ID information with authentication ID information of the other outboard motor and gives the permission to the engine controllers to start the engines when it is determined that the acquired ID information corresponds with the authentication ID information.

3. A method for preventing theft of outboard motors adapted to be mounted on a stern of a boat, each of the outboard motors having an internal combustion engine and an engine controller for controlling operation of the engine, wherein the engine controller and the authenticator of each of the outboard motors are connected by a first wire and each of the first wire is connected by a second wire such that the step of communicating communicates with the engine controller of other of the outboard motors through the second wire, comprising the steps of:

acquiring ID information from an electronic key when the key is brought close thereto by an operator, comparing the acquired ID information with authentication ID information, giving permission to the engine controller to start the engine when it is determined that the acquired ID information corresponds with the authentication ID information, and communicating with the engine controller of other of the outboard motors to notify that the permission to start the engine was given.

4. The method according to claim 3, wherein the step of communicating communicates with other of the outboard motors such that the step of comparing compares the acquired ID information with authentication ID information of the other outboard motor and the step of giving permission gives the permission to the engine controllers to start the engines when it is determined that the acquired ID information corresponds with the authentication ID information.

* * * * *